US008246295B2

(12) United States Patent
Morando

(10) Patent No.: US 8,246,295 B2
(45) Date of Patent: Aug. 21, 2012

(54) RISERLESS TRANSFER PUMP AND MIXER/PRE-MELTER FOR MOLTEN METAL APPLICATIONS

(76) Inventor: Jorge A. Morando, Solon, OH (US)

( * ) Notice: Subject to any disclaimer, the term of this patent is extended or adjusted under 35 U.S.C. 154(b) by 0 days.

(21) Appl. No.: 12/604,000

(22) Filed: Oct. 22, 2009

(65) Prior Publication Data

US 2010/0104415 A1 Apr. 29, 2010

Related U.S. Application Data

(60) Provisional application No. 61/109,352, filed on Oct. 29, 2008.

(51) Int. Cl.
*F04D 29/44* (2006.01)
*F04D 29/22* (2006.01)

(52) U.S. Cl. ..... 415/89; 415/206; 415/231 A

(58) Field of Classification Search ..... 415/89, 415/203, 206, 212.1, 219.1, 222, 226; 416/231 A; 266/235; 417/423.14, 423.1, 424.1
See application file for complete search history.

(56) References Cited

U.S. PATENT DOCUMENTS 3,612,715 A * 10/1971 Yedidiah ..... 415/131
4,128,415 A * 12/1978 Van Linden et al. ..... 75/687
4,286,985 A * 9/1981 Van Linden et al. ..... 75/687
2004/0191138 A1* 9/2004 Wagner ..... 422/232

* cited by examiner

*Primary Examiner* — Nathaniel Wiehe
(74) *Attorney, Agent, or Firm* — Steve M. Clemmons

(57) ABSTRACT

A pump for processing molten metal having an enlarged tubular body which houses a centrifugal pump at its bottom end. The bottom end has a parabolic shape which receives the ejected molten metal from the impeller and forms a vortex within the tubular body. The pump is controlled to cause the vortex to climb up the inner wall of the body up to and out of an outlet formed in the upper end of the body. A radial vane impeller is formed in the back plate of the impeller. When the impeller is rotated, solid particles introduced into the body are accelerated radially by the back plate impeller into the vortex.

14 Claims, 3 Drawing Sheets

RISERLESS TRANSFER PUMP AND MIXER/PRE-MELTER FOR MOLTEN METAL APPLICATIONS

CROSS-REFERENCE TO RELATED APPLICATIONS

This application claims priority of U.S. Provisional Patent Application filed Oct. 29, 2008 having Ser. No. 61/109,352.

FIELD OF THE INVENTION

The present invention relates to lifting molten metals and, more particularly, to a pump creating a vortex within a lift tube to elevate and mix molten metal.

BACKGROUND OF THE INVENTION

A typical molten metal facility includes a furnace with a pump for moving molten metal. During the processing of molten metals, such as aluminum and zinc, the molten metal is normally continuously circulated through the furnace by a centrifugal circulation pump to equalize the temperature of the molten bath. These pumps contain a rotating impeller that draws in and accelerates the molten metal creating a laminar-type flow within the furnace.

To transfer the molten metal out of the furnace, typically for casting the metal, a separate centrifugal transfer pump is used to elevate the metal up through a discharge conduit that runs up and out of the furnace. As shown in FIG. 1, a typical prior art transfer pump includes a base 5, two to three support posts 6 (only one shown), a shaft-mounted impeller 7 located within a pumping chamber or volute 5*a* in the base 5, a motor 8 and motor mount 9 which turn the impeller, bearings 10 that support the rotating impeller (and shaft), and a riser tube or conduit 11 located at the outlet of the base. The riser 11 is provided to allow the metal to lift upward over the sill edge of the furnace in order to transfer some of the molten metal 12 out of furnace into ladles or molds.

A well-known problem with previous transfer pumps, however, is that the relatively narrow riser tube 11 becomes clogged as small droplets of the molten metal accumulate in the riser each time the pump stops transferring and the metal stops flowing through the riser. Initially, the metal accumulates in the porosity of the riser tube material (typically graphite or ceramic) and then continues to build upon the hardened metal/dross until a clog 13 occurs. As a result of this problem, furnace operators must frequently replace the transfer pump's riser tube as they are too narrow to effectively clean. This replacement typically requires the furnace to be shut down for an extended period to remove the clogged riser tube.

Several treatments have been used to alleviate this riser-clogging in transfer pumps. Including impregnating, coating, and inert gas pressurization of the riser to reduce the build-up within the tube. Another method pump manufacturers employ is to simply increase the diameter of the riser to delay the blockage. These treatments have varying degrees of success, but still only delay the inevitable clogging of the riser.

Another common operation in a molten metal facility is to add scrap metal, typically metal working remnants or chips, to the molten bath within a furnace. The heat of the bath melts the chips. Currently, the added chips are simply allowed to fall into the bath or may be mixed into the molten metal by a circulation pump. The current process(es), however, is not effective to fully immerse the solid chips into the molten bath resulting in a longer melt time.

In view of the current inefficient use of molten metal transfer pumps, there is a need for a molten metal pump that overcomes all of the above-indicated drawbacks of prior transfer pumps.

SUMMARY OF THE INVENTION

The present invention provides a molten metal pump including an elongated body having an elongated straight tube that terminates in a parabolically-shaped bottom end. A centrifugal impeller is seated in an inlet opening formed in the center of the bottom end. The parabola shape of the body's bottom end provides a smooth upward transition for metal ejected from the impeller to the inner walls of the straight tube. The rotation of the impeller centered in the parabola results in the ejected flow of molten metal to create a vortex which climbs the inner walls of the body to a outlet opening in an upper portion wall.

It is an advantage of the present invention to provide a pump which creates a forced vortex of molten metal within a vertical tube body of the pump to lift the whirling molten metal for transferring, mixing, and/or pre-melting applications.

It is another advantage of the present invention that the parabolic-shaped lifting cavity has a relatively large internal diameter allowing the inner walls to be readily accessed for cleaning and removal of accumulated metal and dross.

It is still another advantage of the present invention over prior art transfer-type pumps is that the present invention eliminates the support posts, riser tube, and one impeller bearing thereby reducing the complexity of the pump system and reducing the number of components subject to deterioration due to the molten metal environment and which must eventually be replaced.

It is yet another advantage of the present invention to provide an impeller having a bottom plate with a plurality of radial vanes facing into the pump's tubular body.

It is still yet another advantage of the present invention that the radial vanes of the bottom plate causes, when metal scrap chips are inserted into the pump's tubular cavity, the metal chips to be directed radially outwardly into the pump-generated vortex of molten metal. The rotational velocity of the impeller causes the chips to penetrate the surface of the vortex to fully immerse the chips within the molten metal.

These and other objects, features and advantages of the present invention will become apparent from the following description when viewed in accordance with the accompanying drawings.

BRIEF DESCRIPTION OF THE DRAWINGS

The description refers to the accompanying drawings in which like reference characters refer to like parts throughout the several views, and in which.

DETAILED DESCRIPTION OF THE INVENTION

Figure 1:
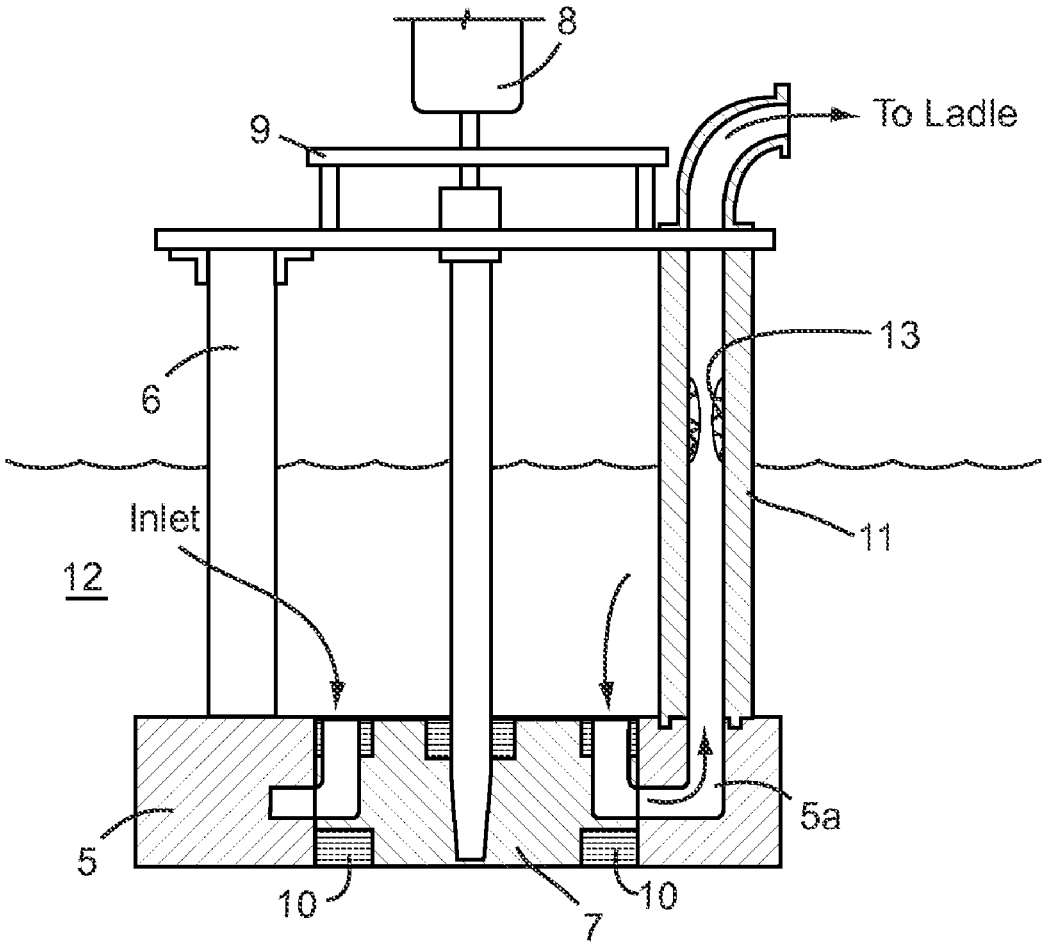
FIG. 1 (Prior Art)
FIG. 1 is a side sectional view of a prior art transfer pump having a riser tube.
Figure 2:
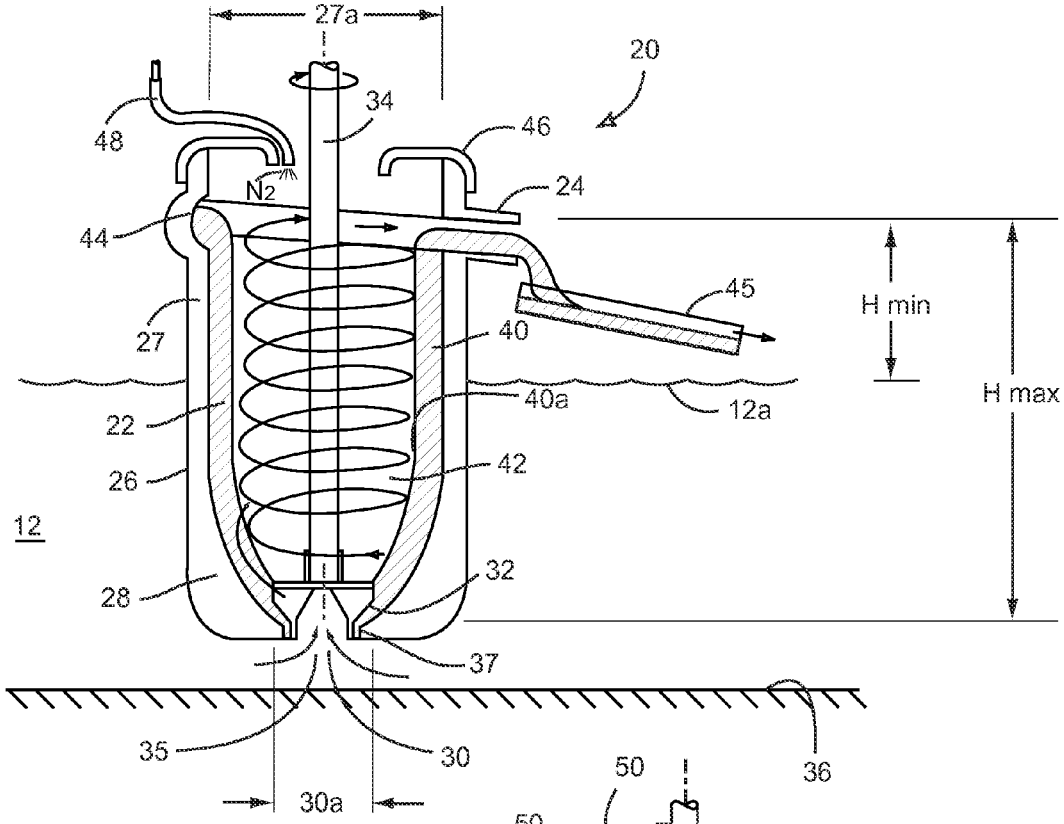
FIG. 2 is a side sectional view of the present invention used in a transfer pump application.

Referring now to FIG. 2, the present invention is molten metal pump 20 which creates a forced vortex of accelerated molten metal within a vertical tube 22 in the pump to lift or raise the molten metal to an outlet 24 in the upper end of the pump.

Pump 20 includes an elongated tubular pump body 26 having a substantially straight cylindrical inner tube wall 27 and a parabolic-shaped bottom end 28. An inlet opening 30 is formed in the center of the concave parabolic end 28. A centrifugal impeller 32 is mounted within opening 30 and is rotated by an elongated output shaft 34 which runs concentrically down through the center of tube body 26. Shaft 34 is driven by a conventional motor (not shown). Inlet opening 30 and the impeller's inlets are suspended above the furnace floor 36 to ensure an adequate amount of molten metal is pulled into pump 20.

Impeller 32 rotates on bearings 37 disposed between the impeller and body 26 to draw in molten metal from bath/matrix 12, which is accelerated in both the radial and tangential direction and expels the accelerated molten metal out of the impeller and into bottom end 28 of the pump body. Impeller 32 is preferably a high velocity and/or high efficiency configuration to generate the molten metal lifting vortex within pump 20. Two examples of such an impeller configuration include the type disclosed in my issued U.S. Pat. No. 7,326,028 entitled HIGH FLOW/DUAL INDUCER/HIGH EFFICIENCY IMPELLER FOR LIQUID APPLICATIONS INCLUDING MOLTEN METAL ("dual inducer impeller") and my pending U.S. patent application Ser. No. 12/239,228 entitled HIGH FLOW/HIGH EFFICIENCY CENTRIFUGAL PUMP HAVING A TURBINE IMPELLER FOR LIQUID APPLICATIONS INCLUDING MOLTEN METAL ("turbine impeller") which are both incorporated herein by reference.

The pump body 26 is preferably formed from a material suitable for molten metal applications, such as a boron nitride impregnated refractory material. It should be appreciated that since most transfer-type molten metal pumps typically only need to lift the metal three to four feet vertically, the straight tube 27 of the pump body has a similar overall length/height.

Tube 27 terminates in a parabolic-shaped end 28, which provides the contour necessary for the impeller to generate the vortex type required by the application at hand.

As shown in FIG. 2, a transferring application is illustrated where the parabolic shape of end 28 has its parabolic focus proximate to its vertex. Further in this transferring application, the forced vortex 40 (i.e., where there is little to no shear in the fluid such that the fluid essentially rotates as a solid body) generated by the rotating impeller takes the shape of what I have termed a "super forced vortex", where the vortex of fluid forms a near constant or uniform depth/thickness and the free surface 40*a* of the fluid has substantially the same parabolic shape as the underlying cavity 42 (defined by tube 27 and parabolic-shaped end 28) in pump body 26.

In the preferred embodiment of a transferring pump, body 26 includes an exit volute 44 in the upper end of the body. Exit volute 44 is a channel recessed in body 26 which redirects the whirling vortex 40 of molten metal out through outlet opening 24 and onto a conventional molten metal sluice 45 to move the exiting molten metal away from the furnace.

The maximum lift, "Hmax", (i.e., the maximum vertical distance a given pump 20 will elevate a given molten metal from the inlet of the impeller) will depend on: a) the internal diameter 27*a* of the pump body's tube; b) the impeller's outer diameter 30*a*; and c) the speed (in rpm) at which the impeller 32 is rotated. For optimum transfer lift the impeller's outer diameter 30*a* is preferably within the range of one-third to one-half the internal diameter 27*a* of the pump body tube 27. The minimum lift, "Hmin", is the vertical distance between the molten metal line 12*a* in the furnace and the height to the outlet opening 24, which results in sufficient material exiting the pump 20 to maintain the desired vortex formed by the incoming/accelerating molten material.

Pump 20 further preferably includes an annular lid or splash protector 46 which substantially covers the upper open end of the tube body 26 while leaving a central opening to allow access for the drive shaft 34. In one embodiment, pump 20 includes a gas injection tube or conduit 48, which passes into cavity 42 to introduce a gas into the molten metal, such as injecting nitrogen gas to flux/clean molten aluminum and prevent the formation of aluminum oxide ($Al_2O_3$).

Figure 3:
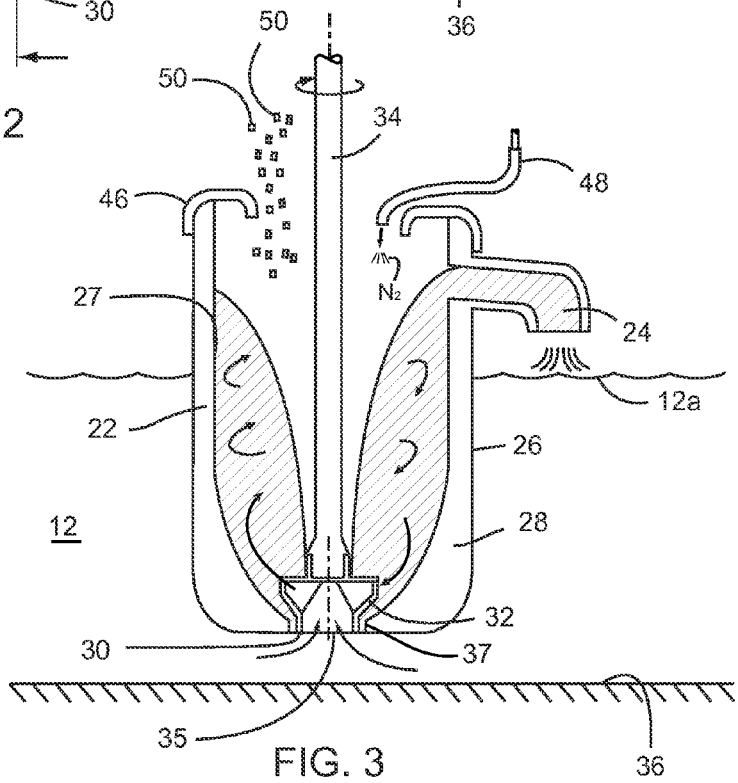
FIG. 3 is a side sectional view of the present invention used in either a mixing or pre-melting application.

Referring now to FIG. 3, if the pump 20 is used as a metal mixer or pre-melter, chips or particles 50 of various materials are introduced into body 26 through the upper end. In one embodiment, the parabolic shape of cavity bottom 28 has a wider configuration than the transferring pump above, with the parabolic focus being as far as practicable from the parabolic vertex. In the mixing application, the height of the lifted metal should be maintained at a minimum to ensure proper dispersion of the particles 50 added for mixing with the metal matrix/bath 12. This will depend on: a) the materials being mixed; b) the particles' size; c) the wetability of the particles; d) the mixing speed (rpm); and e) the impeller configuration and tip velocity. In one embodiment of this mixing application, an "ordinary" forced vortex 40 is generated where the free surface 40*a* is parabolic resulting in a varying radial thickness or depth of the molten metal, which narrows as the flow rises up the tube walls 27. That is, more molten metal can be found proximate to the lower end 28 in pump body 26 than at the upward end of the vertical tube.

As shown in FIG. 3, while mixing, the flow out of the pump 20 returns the lifted molten metal to the furnace until the mixing is completed, then casting can start. Preferably, the outlet 24 is located proximate to the furnace metal line 12*a* to reduce turbulence and dross formation.

If the riserless pump 20 is utilized as a pre-melting system the conditions are similar to the mixing application described above, except the particles' 50 residence time in the vortex 40 and the vortex's outlet flow should be such as to guarantee the complete melting of the material 50 added to the vortex to assure sufficient heat is available to cause the solid particles to melt without overcooling either the melting or the melted flow.

In the mixing and pre-melting applications, the forced vortex 40 would be optimally generated by means of my dual inducer impeller or turbine impeller. These impellers generate a very balanced flow versus head performance curve assuring high melting flow and moderate to high recirculation (residence time).

For optimum mixing or pre-melting applications the impeller outside diameter 30*a* is preferably within the range of one-fourth to one-third the internal diameter 27*a* of the pump body tube 27 to guarantee larger flows and longer residence times of the particles to be melted within or dispersed throughout the metal matrix/bath 12.

Figure 4:
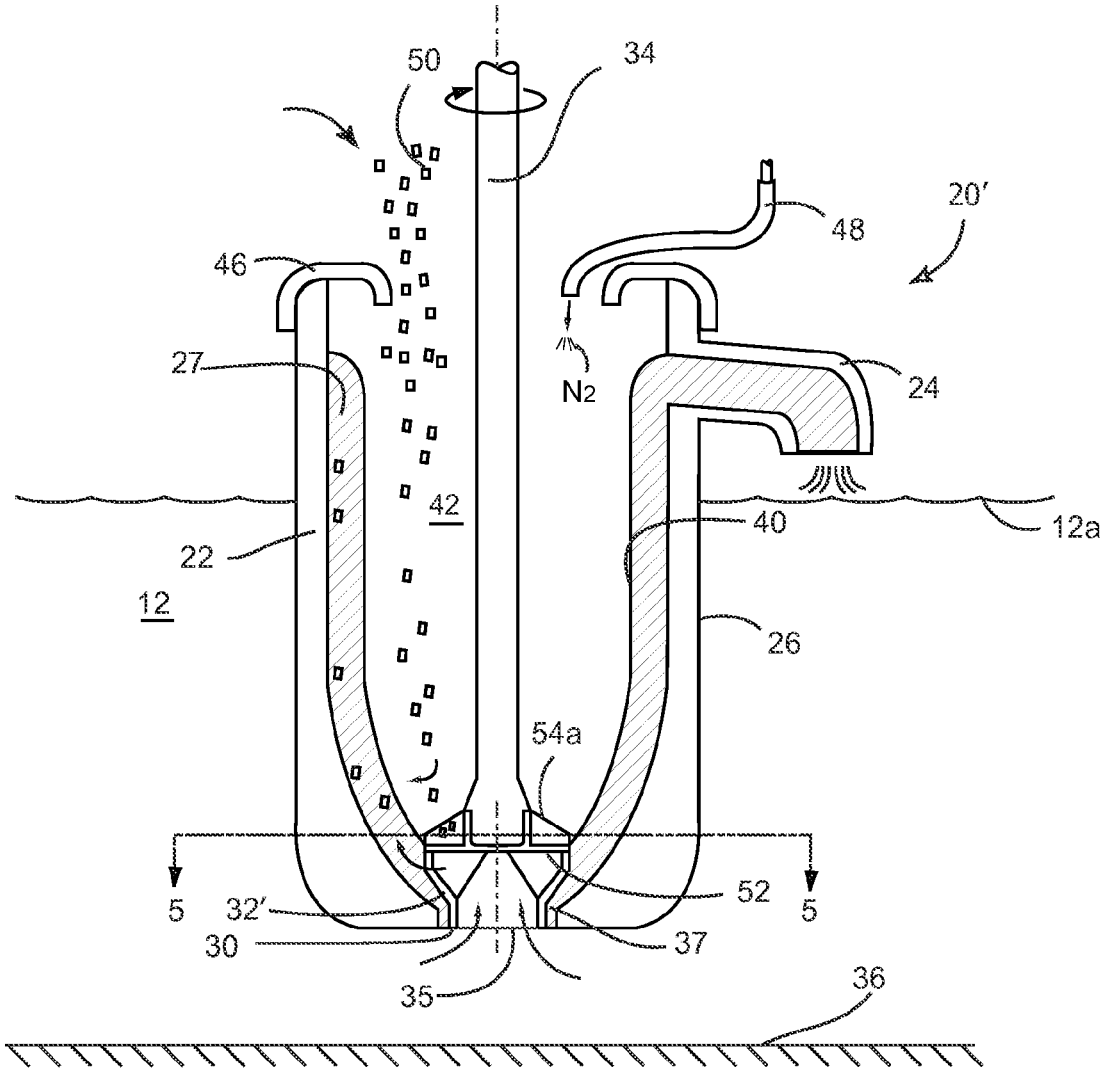
FIG. 4 is a side sectional view of an alternate embodiment of the present invention having an impeller with a plurality of radially extending vanes formed into the impeller's back plate.
Figure 5:
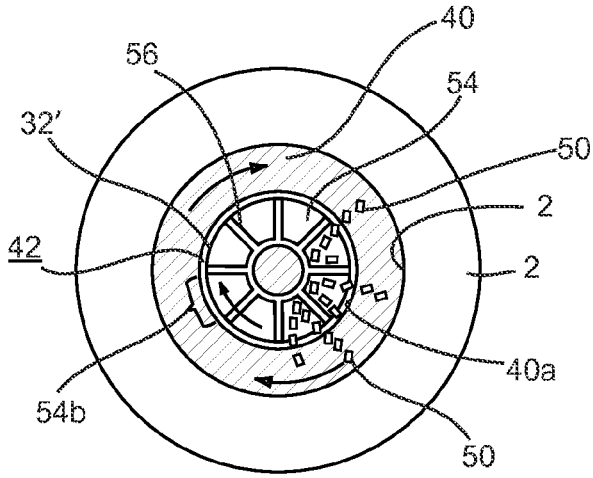
FIG. 5 is a top sectional view through line 5-5 in FIG. 4 showing the radially accelerated metal particles penetrating the impeller induced vortex.

Referring now to FIGS. 4 and 5 an alternate riserless pump 20' having an impeller 32' which is substantially the same as impeller 32 described above, except that impeller 32' has a much thicker back plate portion 52 (i.e., the face of the impeller opposite to the surface bearing the molten metal inlets 35) than impeller 32. Within the thickened back plate 52 is a plurality of spaced channels 54 which form a plurality of spaced mixing vanes 56 that extend radially outwardly from a central driveshaft mounting hub. These spaced vanes cooperatively form a second impeller which directs any material entering channels 54 in a substantially radial outward direction away from the impeller. As shown, when the impeller 32' is inserted within inlet opening 30 of the pump body 26, the inlets 54*a* of channels 54 are open to the internal cavity 42 facing in the opposite direction of lifting impeller inlets 35, while the channel outlets 54*b* face toward the inner wall 27.

In another embodiment, the integrated second impeller formed within back plate 52 may be replaced with a separate second impeller mounted to the back plate of lifting impeller 32. Like the integrated second impeller, this second impeller would include open channels 54 and vanes 56 substantially the same as those described above.

In a mixing or pre-melting operation, solid particles 50 are introduced into cavity 42 through the upper end of the body 26. As discussed above, when the impeller 32' is turning at-speed, the flow of molten metal exiting the impeller forms either a forced or super-forced vortex which travels up the tube walls 27. The solid particles 50 fall in the axial direction into the inlets 54*a* of the rotating channels 54 formed in the upper surface of back plate 52 and due to the radially extending vanes 56 are re-directed or thrown in a substantially radial direction out of channel outlets 54*b* into the vortex of molten metal. Importantly, the rotational speed of the impeller 32' which is necessary to lift the molten metal up along walls 27 causes the particles 50 being ejected by the radial vanes 56 in the back plate to have sufficient velocity to fully penetrate into the liquid vortex, i.e., beyond the inward-facing surface 40*a* of the vortex, thereby allowing the molten material to fully engulf the solid particles 50 to maximize heating/melting efficiency.

Although the riserless pump 20 has several applications, the general design remains substantially the same except only the lifting capability of the vortex 40 is utilized in the transfer application, while the lifting, mixing and recirculation capabilities are used in conjunction to achieve the ultimate requirements for mixing and pre-melting.

From the foregoing description, one skilled in the art will readily recognize that the present invention is directed to an improved molten metal pump system that rotates the molten metal within an internal cavity creating a vortex of molten metal along the vertical cavity wall, which rises up to an outlet at the upper end of the wall. While the present invention has been described with particular reference to various preferred embodiments, one skilled in the art will recognize from the foregoing discussion and accompanying drawing and claims that changes, modifications and variations can be made in the present invention without departing from the spirit and scope thereof.

The invention claimed is:

1. A molten metal pump comprising:

an elongated body having a vertical straight tube having an internal cavity defined by an inner wall which tapers down and terminates in a parabolically-shaped bottom end; and a centrifugal impeller seated in an opening formed in the center of said bottom end, wherein molten metal ejected from the impeller is received by the parabolically-shaped bottom end, wherein said impeller has an outer diameter which is approximately one-third to one-half of the diameter of said inner wall;

whereby rotation of the impeller results in the ejected flow of molten metal to create a vortex which climbs the inner wall to an outlet opening passing through an upper portion of said body.

2. A pump as defined in claim 1, wherein said impeller has vertically downward facing liquid inlets.

3. A pump as defined in claim 2, further comprising a drive shaft extending concentrically down through the tube and attached to a hub formed in a back plate of said impeller.

4. A pump as defined in claim 3, wherein said impeller includes a plurality of radially extending spaced vanes on an upper surface of said back plate, wherein adjacent vanes define channels each having a channel inlet open to said internal cavity and a channel outlet facing said inner wall.

5. A pump as defined in claim 4, wherein solid particulate matter entering said channel inlets is ejected through said channel outlets and into said vortex such that said ejected solid particulate matter is fully immersed within said vortex.

6. A pump as defined in claim 2, wherein said liquid inlet openings are formed through a bottom face of said impeller, said impeller further comprising a plurality of spaced vane arms extending radially along a top face disposed opposite to the bottom face, wherein said spaced vane arms define a plurality of channels having channel inlets which are open axially to said internal cavity and channel outlets which are open radially to said internal cavity.

7. A pump as defined in claim 1, wherein said vortex has a substantially uniform thickness along said inner wall and above said bottom end.

8. A pump as defined in claim 1, further comprising means for mixing solid particulate matter within said vortex, wherein said mixing means is formed within an upper face of said impeller and is effective to redirect said solid particulate matter radially into said vortex.

9. A molten metal pump comprising:

an elongated body having a vertical straight tube having an internal cavity defined by an inner wall which tapers down and terminates in a parabolically-shaped bottom end; and a centrifugal impeller seated in an opening formed in the center of said bottom end, said impeller including downward facing liquid inlets, wherein said impeller has an outer diameter which is approximately one-fourth to one-third of the diameter of said inner wall; and a drive shaft extending concentrically down through the tube and attached to a hub formed in a back plate of said impeller;

wherein molten metal ejected from the impeller is received by the parabolically-shaped bottom end, whereby rotation of the impeller results in the ejected flow of molten metal to create a vortex which climbs the inner wall to an outlet opening passing through an upper portion of said body, wherein said impeller has vertically.

10. A pump which is immersible in a bath of molten metal, comprising:

a vertical riser tube having an inner wall which defines an internal cavity and having outlet means formed at an upper end of the tube which fluidly connects the internal cavity to transfer means external to said riser tube;

a centrifugal impeller rotatably seated coaxially within an opening formed in the center of a bottom end of said riser tube, wherein molten metal ejected from the impeller is received by said inner wall, wherein said impeller has an outer diameter which is approximately one-fourth to one-half of the diameter of said inner wall;

whereby rotation of the impeller results in the ejected molten metal to create a vortex within said riser tube and along said inner wall, said vortex climbs the inner wall to said outlet means;

wherein said bottom end has a concave parabola shape.

11. A pump as defined in claim 10, wherein said vortex has a substantially uniform thickness along said inner wall and above said bottom end.

12. A pump as defined in claim 10, further comprising means for mixing solid particulate matter within said vortex, wherein said mixing means is formed within an upper face of said impeller and is effective to redirect said solid particulate matter radially into said vortex.

13. A pump as defined in claim 12, wherein said liquid inlet openings in a bottom face, said impeller further comprising a plurality of spaced vane arms extending radially along a top face disposed opposite to the bottom face, wherein said spaced vane arms define a plurality of channels having channel inlets which are open axially to said internal cavity and channel outlets which are open radially to said internal cavity.

14. A pump as defined in claim 12, wherein the solid particulate matter entering said channel inlets is ejected through said channel outlets and into said vortex such that said ejected solid particulate matter is fully immersed within said vortex.

* * * * *